United States Patent [19]

Vernet et al.

[11] Patent Number: 5,071,576

[45] Date of Patent: Dec. 10, 1991

[54] LUBRICANT OIL ADDITIVE

[75] Inventors: Marc R. Vernet, Andresy, France; Graham W. Hamey, Radley, United Kingdom

[73] Assignee: Exxon Chemical Patents Inc., Linden, N.J.

[21] Appl. No.: 255,887

[22] Filed: Oct. 11, 1988

[30] Foreign Application Priority Data

Oct. 12, 1987 [GB] United Kingdom ..... 8723909

[51] Int. Cl.[5] ..... C10M 159/24

[52] U.S. Cl. ..... 252/33.4; 252/18; 252/40.5; 252/42; 252/33.3; 252/25

[58] Field of Search ..... 252/33, 18, 33.3, 33.4, 252/25, 39, 42, 40.5

[56] References Cited

U.S. PATENT DOCUMENTS

| | | | |
|---|---|---|---|
| 3,133,019 | 5/1964 | Otto et al. | 252/33 |
| 3,158,572 | 11/1964 | Andress, Jr. | 252/33 |
| 4,123,369 | 10/1978 | Miller et al. | 252/33 |
| 4,140,642 | 2/1979 | Kistler et al. | 252/33 |
| 4,251,379 | 2/1981 | Le Coent et al. | 252/33 |
| 4,470,916 | 9/1984 | Le Coent et al. | 252/33.4 |

FOREIGN PATENT DOCUMENTS

| | | |
|---|---|---|
| 1103699 | 6/1981 | Canada . |
| 0001318 | 7/1978 | European Pat. Off. . |
| 2135330A | 8/1984 | United Kingdom . |

*Primary Examiner*—Jacqueline V. Howard
*Attorney, Agent, or Firm*—J. B. Murray, Jr.

[57] ABSTRACT

A lubricant oil additive comprising a liquid vehicle and an overbased mixture of (A), a metal phenate, (B) a long chain metal alkyl aryl sulphonate and optionally, (C) a medium long chain metal alkyl aryl sulphonate shows an improved storage stability.

17 Claims, 1 Drawing Sheet

LUBRICANT OIL ADDITIVE

Figure 1:
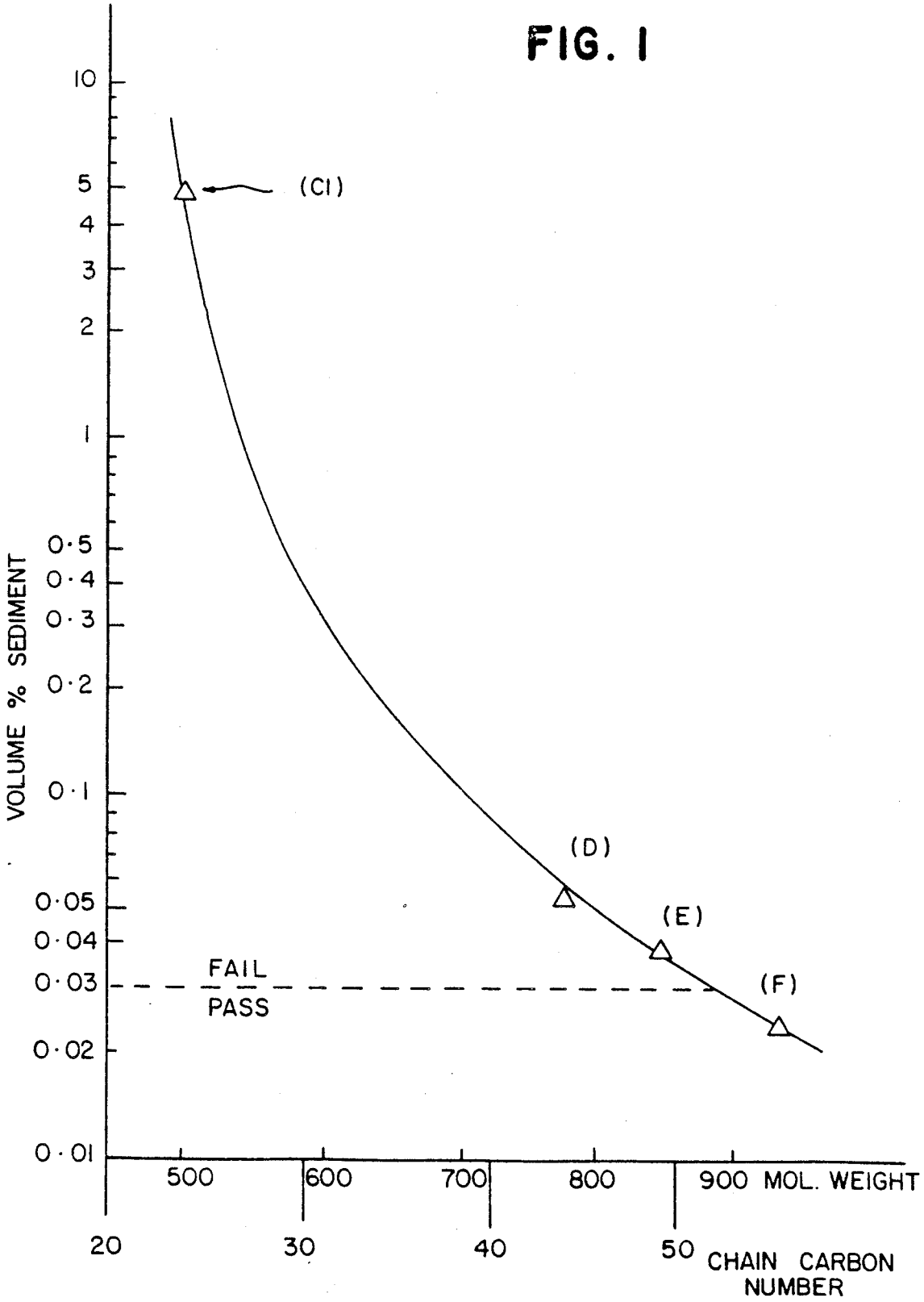

This invention concerns a lubricant oil additive comprising an overbased mixture of a metal phenate and a metal alkyl aryl sulphonate.

Metal phenates and metal alkyl aryl sulphonates of this general type are known. The term "overbased" is used to describe metal salts in which the metal is present in stoichiometrically larger amounts than the phenate or sulphonate radical. In marine formulations, i.e. in lubricant oil formulations for use in marine engines, these additives are used at hight treat rates. One of the problems encountered with these additives and especially with marine formulations, is that the phenate component and the sulphonate component tend to interact and precipitate during storage.

Accordingly it is an object of this invention to provide a lubricant oil additive comprising an overbased mixture of a metal phenate component and a metal alkyl aryl sulphonate component which does not lead to precipitation during storage.

This object is attained in accordance with this invention by providing a lubricant oil additive comprising a liquid vehicle and a mixture of:

(A) an overbased metal phenate, (B) an overbased metal alkyl aryl sulphonate containing 1 to 3 alkyl groups, one of which alkyl groups contains an average number of carbon atoms of at least 40 while any remaining alkyl groups contain less than 10 carbon atoms, and (C) optionally, an overbased metal alkyl aryl sulphonate containing 1 to 3 alkyl groups, one of which alkyl groups contains an average number of carbon atoms of 10 to 33, while any remaining alkyl groups contain less than 10 carbon atoms.

Hereinafter, the term "long chain alkyl group" is used for alkyl groups containing an average number of carbon atoms of at least 40. The term "medium long chain alkyl group" is used for alkyl groups containing an average number of carbon atoms of 10 to 33. The term "short chain alkyl group" is used for alkyl groups containing less than 10 carbon atoms. These alkyl groups need not necessarily be chains, but they can be linear, branched or cyclic alkyl groups. Usually they are saturated alkyl groups, but they can also some degree of unsaturation.

Surprisingly, the phenate/sulphonate combinations according to the present invention, which contain long chain alkyl aryl sulphonates, have a strongly reduced tendency to precipitate during storage. The long chain alkyl aryl sulphonate may be used as the sole sulphonate component of the phenate/sulphonate mixture. Alternatively, it may be used in conjunction with medium long chain alkyl aryl sulphonates.

When a mixture of long and medium long chain alkyl aryl sulphonates is employed then the sulphonate component of the lubricant oil additive according to the present invention is characterised by a size distribution of the long and medium long chain alkyl residues which may be called "dumb-bell distribution". In many cases, e.g. when the sulphonic acids employed in the mixture are identical except for the size of their long and medium long chain alkyl residues the dumb-bell distribution of the size of the alkyl residues is reflected by a similar distribution of the molecular weights. Mixtures of alkyl aryl sulphonates with a dumb-bell type of molecular weight distribution are one of the preferred sulphonate components of the lubricant oil additives according to the present invention.

Overbased components (A), (B) and (C) are prepared in a liquid vehicle which is a solvent for the alkyl aryl sulphonic acid or phenol starting materials. Preferably, the liquid vehicle is also a lubricant, e.g. a mineral oil fraction or a synthetic oil.

The metal present in each of (A), (B) and (C) is usually a group I or a group II metal, such as lithium, sodium, potassium, magnesium, calcium, strontium, or barium. It is also possible that combinations of these metals are employed. Alkaline earth metals and especially calcium and magnesium are preferred. The alkaline earth metal compounds which may be used to provide the sulfonates includes the oxides and hydroxides, alkoxides, carbonates, carboxylate, sulfide, hydrosulfide, nitrate, borates and ethers. Examples are calcium oxide, calcium hydroxide, magnesium acetate and magnesium borate.

The components used in this invention have a high total base number, as measured by ASTM D2896, which preferably is in the range of 30–400, especially 250–350. Overbased metal phenates or "metal phenates" is a term used to refer to overbased metal sulphurised hydrocarbyl phenates which are high alkalinity sulphurised hydrocarbyl phenates which contain metal base in excess of that required for neutralisation of the sulphurised hydrocarbyl phenol. The overbased phenates where the hydrocarbyl groups(s) are alkyl group(s) are preferred, and the preparation of overbased phenates will be described in relation to these preferred phenates.

The starting alkyl phenol may contain one or more alkyl substituents. These may be branched or unbranched, and depending on the number of substituents be $C_1$ to $C_{30}$, preferably $C_9$ to $C_{18}$ groups. Mixtures of alkyl phenols with different alkyl substituents may be used.

The alkyl phenol may be sulphurised as a separate step before the overbasing stage described hereinafter. This sulphurization may be accomplished by reacting the alkyl phenol with sulphur chloride or by reaction with sulphur in the presence of a base. Alternatively, the reaction with sulphur may be carried out as part of the overall overbasing process. In addition to the desired sulphurised alkyl phenol of the general formula:

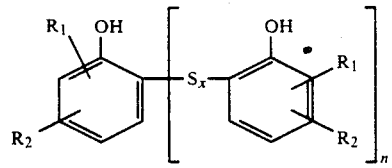

(where x is an integer from 1 to 4, n is an integer from 1 to 10, $R_1$ is a $C_1$–$C_{30}$ alkyl group, for example a $C_9$–$C_{18}$ alkyl group and $R_2$ is hydrogen or said alkyl group), the product may contain a minor amount (typically 10 wt. % or less of the sulphurized alkyl phenol) of a number of byproducts resulting from side reactions, e.g. chlorination of the aromatic ring when using sulphur chloride, or formation of organo sulphur groups resulting from reaction of sulphur with overbasing reaction solvents.

The sulphurised alkyl phenol is reacted with excess base, preferably an alkaline earth metal base in the presence of a solvent which is usually ethylene glycol although other glycols may be used. An additional monohydroxyl solvent (e.g. isodecanol) may also be used. The alkaline earth metal base may be an oxide or a hydroxide. Carbon dioxide is then introduced to convert the excess metal base into metal carbonate. Volatile reaction products and solvents are then removed by distillation filtration or centrifugation. Alternatively, as indicated above, sulphur and alkyl metal may be charged prior to carbonation to form the sulphurised phenol in situ, which is then reacted with base and carbonated as described. As an alternative a metal alkoxide may be used as the starting metal base and the inclusion of water is then required to hydrolyse the alkoxides. For this modification, glycol ethers are suitable solvents. A carbonated metal alkoxide can also be used.

Highly preferred overbased phenates are the overbased calcium phenates. A preferred process for preparation of overbased calcium phenate is described in GB 1 470 338. A modification of these processes is described in EP0094814.

In the alkyl aryl sulphonates the sulphonic acid residue is directly bonded to an aromatic group. Preferred aromatic groups are benzene, toluene and naphthalene, benzene being especially preferred.

The overbased metal sulphonates in the composition of the invention may be prepared by any suitable overbasing process and such processes are known in the art. The composition comprising (A) and (B) may either be prepared by overbasing a mixture of suitable alkyl aryl sulphonic acids, or by separate overbasing of individual alkyl aryl sulphonic acids followed by mixing the overbased products. In the former case the mixture of sulphonic acids may either be prepared by sulphonation of mixed alkyl aromatic compounds or by admixture of separately prepared alkyl aryl sulphonic acids.

The effect that precipitation is avoided can be observed whenever a sulphonate component according to the present invention, which contains a long chain alkyl aryl sulphonate, is blended with phenates. Usually such a phenate/sulphonate blend contains 10 to 90 wt % of the phenate component (A) and 90–10 wt % of the sulphonate component, i.e. combined components (B) and (C).

It is preferred that the long chain alkyl group in component (B) is a branched alkyl group. Particularly suitable are branched long chain alkyl groups which contain an average number of carbon atoms of at least 50. Usually, the branched long chain alkyl group is a mixture of alkyl groups selected from $C_{18}$–$C_{200}$ alkyl groups. Such alkyl groups may be prepared, for example, from polymerization of propylene or butylene, specifically n-butene, using known techniques.

Two different types of medium long chain alkyl groups in component (C) are preferred. In component (C1) the aryl group is substituted with alkyl groups selected from $C_{15}$–$C_{40}$ branched chain alkyl groups, the average number of carbon atoms being 15 to 33. Component (C2) is an alkyl aryl sulphonate containing $C_{10}$–$C_{30}$ straight chain alkyl groups. Components (C1) and (C2) may be either pure compounds or mixtures of compounds. Preferably, component (C1) comprises a mixture of branched medium long chain alkyl groups while component (C2) is a substantially pure compound, i.e. all molecules of component (C2) contain the same medium long straight chain alkyl group. It is especially preferred that the medium long straight chain alkyl groups are selected from $C_{15}$–$C_{25}$ straight chain alkyl groups.

Optionally, components (A) and (B) contain one or two short chain alkyl groups in addition to the long or medium long chain alkyl groups. The preferred short chain alkyl groups are methyl and ethyl.

Usually the sulphonate component of the lubricant oil additive according to the present invention is either a binary mixture of component (B) and (C1) or (B) and (C2), respectively, or a ternary mixture of (B), (C1) and (C2). The sulphonate component preferably contains not more than 40 wt % of component (C1) and not more than 80 wt % of component (C2). If the sulphonate component is a binary or ternary mixture, then the proportion of component (B) in this mixture is determined depending on the proportion of component (C2). Component (B) makes up $(60-x/2)$ to 99 wt % of the mixture, x being the proportion of component (C2) in the sulphonate component. Table 1 illustrates the relationship between the proportions of component (B) and (C2) in the sulphonate component of the lubricant oil additive.

TABLE 1

| wt % C2 | wt % B |
|---|---|
| 0 | 60–99 |
| 20 | 50–99 |
| 40 | 40–99 |
| 60 | 30–99 |
| 80 | 20–99 |

The lubricant oil additive of the invention may be used in lubricant oil formulation in combination with other conventional lubricant additives. It is particularly useful in marine formulations and this invention extends to such formulations.

The invention is further illustrated by the following examples.

In the examples the calcium salt of a sulphurised alkyl substituted phenol with a TBN of 250 was employed as the phenate component (A). Two different charges of this calcium phenate (A) had been obtained from different suppliers. These different charges are designated in the examples as "phenate I" containing 9.5% Ca and "phenate II" containing 9.25% Ca.

The following alkyl aryl sulphonic acids were used in the examples as starting materials in the preparation of the lubricant oil additive.

(B), a branched long chain monoalkyl benzene sulphonic acid containing a mixture of alkyl residues with an average number of carbon atoms of 50.

(C1), a branched medium long chain monoalkyl benzene sulphonic acid containing a mixture of alkyl residues with an average number of carbon atoms of 24.

(C2), a substantially pure straight chain $C_{18}$ monoalkyl benzene sulphonic acid.

(D), a branched chain monoalkyl benzene sulphonic acid containing a mixture of alkyl residues with an average number of carbon atoms of 44.

(E), a branched chain monalkyl benzene sulphonic acid containing a mixture of alkyl residues containing an average number of carbon atoms of 49.

(F), a branched long chain monoalkyl benzene sulphonic acid containing a mixture of alkyl residues with an average number of carbon atoms of 55.

EXAMPLES 1-8. EXAMPLE 9 (COMPARATIVE EXAMPLE)

An overbased calcium sulphonate composition was prepared starting from sulphonic acid (B) or the binary sulphonic acid mixtures specified in Table 2. The sulphonic acid starting material was converted into an overbased calcium sulphonate solution of the following composition.

| | wt % |
|---|---|
| Calcium sulphonate | 28 |
| Calcium carbonate | 23 |
| Calcium hydroxide | 3 |
| Water | 0.2 |
| Oil | 45 |
| Impurities | 0.8 |
| TBN | 300 |

42.9 wt % of this overbased calcium sulphonate solution, 42.9 wt % of an overbased solution of phenate I and 14.2 wt % of oil (150 neutral) were blended at 60° C. for one hour to form an additive concentrate. 28.12 wt % of the additive concentrate were blended with 71.88 wt % of oil (600 neutral) for one hour at 60° C. to obtain an oil blend. Two samples of the oil blend were stored for 8 weeks in 100 ml centrifuge tubes, one at 20° C. and the other at 60° C. Then for each sample the volume of sediment formed during storage was determined.

For some starting materials the experiment was repeated once or twice. For each starting material it was repeated at least once using phenate II. The results of experiments 1-9 are summarised in Table 2.

It is obvious from Table 2 that the blends according to this invention, i.e. the oil blends of examples 1-8, form far less sediment during storage than the blend of comparative example 15 which did not contain the long chain alkyl aryl sulphonate.

EXAMPLES 10-12

Examples 1, 4 and 8 were repeated with the difference that instead of the monoalkyl benzene sulphonic acids, the corresponding 2-methyl-5-alkyl benzene sulphonic acid and 2-alkyl-5-methyl isomer (containing also some 3-methyl-4-alkyl sulphonic acid and 3-alkyl-4-methyl isomer) were employed as the starting materials in the preparation of the overbased sulphonate compositions. After 8 weeks' storage of the oil blends of at 20° C. and 60° C. the amount of sediment formed was in all cases below 0.03 volume %.

EXAMPLES 13-16

Example 1 was repeated with the difference that instead of sulphonic acid (B), the following sulphonic acid was employed in the respective example.

Example 13: (C1).
Example 14: (D).
Example 15: (E).
Example 16: (F).

The results of examples 13-16 are summarised in FIG. 1. This series of experiments demonstrates that the stability of the oil blends increases when longer chain alkyl aryl sulphonates are used.

TABLE 2

Stability of Phenate/Sulphonate Formulations

| Example | Run | Sulphonic Acid (B) | (C1) | (C2) | Vol. % sediment after 8 weeks: Phenate I 20° C. | Phenate I 60° C. | Phenate II 20° C. | Phenate II 60° C. |
|---|---|---|---|---|---|---|---|---|
| 9 | | | 75 | 25 | 9 | 6 | 4 | 5 |
| 1 | 1 | 100 | | | 0.09 | 0.01 | 0.1 | 0.03 |
| | 2 | | | | 0.04 | 0.03 | 0.04 | 0.05 |
| | 3 | | | | 0.05 | 0.02 | 0.01 | 0.05 |
| 2 | 1 | 87.5 | 12.5 | | 0.01 | 0.02 | 0.02 | 0.02 |
| | 2 | | | | 0.35 | 0.01 | 0.20 | 0.05 |
| 3 | 1 | 83 | 17 | | 0.01 | 0.03 | 0.01 | 0.04 |
| | 2 | | | | 0.04 | 0.01 | 0.01 | 0.02 |
| 4 | 1 | 75 | 25 | | 0.02 | 0.01 | 0.01 | 0.01 |
| | 2 | | | | 0.02 | 0.01 | 0.02 | 0.01 |
| | 3 | | | | 0.02 | 0.02 | 0.02 | 0.03 |
| 5 | 1 | 87.5 | | 12.5 | 0.05 | 0.01 | 0.01 | 0.02 |
| 6 | 1 | 83 | | 17 | 0.06 | 0.02 | 0.02 | 0.03 |
| 7 | 1 | 75 | | 25 | 0.20 | 0.02 | 0.01 | 0.03 |
| | 2 | | | | 0.01 | 0.03 | 0.02 | 0.01 |
| | 3 | | | | Trace | 0.01 | Trace | 0.03 |
| 8 | 1 | 50 | | 50 | 0.01 | 0.02 | 0.02 | 0.04 |
| | 2 | | | | 0.01 | 0.03 | 0.01 | 0.02 |
| | 3 | | | | Trace | 0.01 | Trace | 0.01 |

We claim:

1. A lubricant oil additive exhibiting reduced precipitate formation comprising a liquid vehicle and an overbased mixture of:

(A) an overbased metal phenate, (B) an overbased metal alkyl aryl sulphonate containing 1 to 3 alkyl groups, one of which alkyl groups contains an average number of carbon atoms of at least 40 while any remaining alkyl groups contain less than 10 carbon atoms and, (C) optionally, an overbased metal alkyl aryl sulphonate containing 1 to 3 alkyl groups, one of which alkyl groups contains an average number of carbon atoms of 10 to 33, while any remaining alkyl groups contain less than 10 carbon atoms.

2. An additive according to claim 1 wherein the metal is selected from Group I metals and Group II metals.

3. An additive according to claim 2 wherein the metal is calcium or magnesium.

4. An additive according to claim 1, in which each of (A), (B) and (C) has a total base number of 30 to 400.

5. An additive according to claim 4, in which (A), (B) and (C) have a total base number of 250 to 350.

6. An additive according to claim 1, wherein the phenate is a sulphurised hydrocarbyl phenate.

7. An additive according to claim 6 wherein the phenate is a metal salt of 2,2'-thio-bis-alkyl phenol.

8. An additive according to claim 7 wherein the alkyl group of the alkyl phenate is a $C_5$-$C_{30}$ alkyl group.

9. An additive according to claim 1, wherein the alkyl aryl sulphonates are alkyl benzene sulphonates.

10. An additive according to claim 1, containing 10 to 90 wt % of component (A) and a total of 90 to 10 wt % of combined components (B) and (C).

11. An additive according to claim 1, wherein the alkyl group in component (B) which contains an average number of carbon atoms of at least 40 is a branched chain alkyl group.

12. An additive according to claim 11 wherein said branched chain alkyl group contains an average number of carbon atoms of at least 50.

13. An additive according to claim 1, wherein component (C) is (C1) an alkyl aryl sulphonate containing $C_{15}$-$C_{40}$ branched chain alkyl groups, the average number of carbon atoms in the branched alkyl groups being 15 to 33, and (C2) an alkyl aryl sulphonate containing $C_{10}$–$C_{30}$ straight chain alkyl groups.

14. An additive according to claim 1, comprising a combination of (A) an overbased metal phenate, (B) a mixture of overbased metal alkyl benzene sulphonates containing 1 to 3 alkyl groups, one of which alkyl groups is a branched long chain alkyl group containing 18 to 200 carbon atoms while any remaining alkyl groups contain less than 10 carbon atoms, the average number of carbon atoms in the branched long chain alkyl group being at least 40, and optionally (C1) a mixture of overbased metal alkyl benzene sulphonates containing 1 to 3 alkyl groups, one of which alkyl groups is a branched medium long chain alkyl group containing 10 to 40 carbon atoms while any remaining alkyl groups contain less than 10 carbon atoms, the average number of carbon atoms in the branched medium long chain alkyl group being 15 to 33, and/or (C2) a substantially pure overbased metal alkyl benzene sulphonate containing 1 to 3 alkyl groups, one of which alkyl groups is a $C_{10}$–$C_{30}$ straight chain alkyl group while any remaining alkyl groups contain less than 10 carbon atoms.

15. An additive according to claim 14 wherein the straight chain alkyl group of component (C2) is a $C_{15}$–$C_{25}$ alkyl group.

16. Line 1, delete "A composition" and insert "An additive".

17. A lubricant oil composition containing a lubricant oil additive exhibiting reduced precipitate formation comprising a liquid vehicle and an overbased mixture of:

(A) an overbased metal phenate, (B) an overbased metal alkyl aryl sulphonate containing 1 to 3 alkyl groups, one of which alkyl groups contains an average number of carbon atoms of at least 40 while any remaining alkyl groups contain less than 10 carbon atoms and, (C) optionally, an overbased metal alkyl aryl sulphonate containing 1 to 3 alkyl groups, one of which alkyl groups contains an average number of carbon atoms of 10 to 33, while any remaining alkyl groups contain less than 10 carbon atoms.

* * * * *